US007955039B2

(12) United States Patent
Yamamoto

(10) Patent No.: US 7,955,039 B2
(45) Date of Patent: Jun. 7, 2011

(54) METHOD OF CREATING BOOKLET COVER AND BOOKLET COVER KIT

(75) Inventor: Takemi Yamamoto, Nagoya (JP)

(73) Assignee: Lab. At-Site Ltd., Nagoya-Shi, Aichi (JP)

( * ) Notice: Subject to any disclaimer, the term of this patent is extended or adjusted under 35 U.S.C. 154(b) by 618 days.

(21) Appl. No.: 11/886,955

(22) PCT Filed: Apr. 4, 2006

(86) PCT No.: PCT/JP2006/307075

§ 371 (c)(1),
(2), (4) Date: Sep. 24, 2007

(87) PCT Pub. No.: WO2006/109611

PCT Pub. Date: Oct. 19, 2006

(65) Prior Publication Data

US 2009/0026750 A1 Jan. 29, 2009

(30) Foreign Application Priority Data

Apr. 6, 2005 (JP) ..... 2005-109904

(51) Int. Cl.
*B42C 7/00* (2006.01)
*B42C 9/00* (2006.01)
*B42D 3/00* (2006.01)

(52) U.S. Cl. ..... 412/3; 412/8; 412/17; 281/29

(58) Field of Classification Search ..... 412/3, 8, 412/17; 281/29; 156/250, 253, 256; 33/620, 33/623

See application file for complete search history.

(56) References Cited

U.S. PATENT DOCUMENTS 1,495,467 A * 5/1924 White ..... 281/29
2,390,125 A * 12/1945 Schade ..... 281/29
2,667,909 A * 2/1954 Stobb ..... 156/444

(Continued)

FOREIGN PATENT DOCUMENTS

CN 1781728 A 6/2006

(Continued)

OTHER PUBLICATIONS

English translation of JP2003-205692A.
English translation of JP-U-3101717.

*Primary Examiner* — Shelley Self
*Assistant Examiner* — Kyle Grabowski
(74) *Attorney, Agent, or Firm* — Thomas, Kayden, Horstemeyer & Risley, LLP

(57) ABSTRACT

A peeling sheet on the back of a cover sheet is provided with a cover seal having a printed front surface is peeled off to partially expose an adhesive layer. A core material for cover is placed thereon. First side piece portion and second side piece portion are then peeled off and the entire surface of the first cover members, backbone member and second cover member of the core material for cover is bonded and fixed by the adhesive layer of the cover sheet for cover. Outer circumferential region of the cover seal for cover is then bent to the inside thus making a cover of a booklet. When a personal user edits electronic images and prints the electronic images on a printed sheet, the printed sheet can be fixed easily in a short time for making a booklet.

5 Claims, 18 Drawing Sheets

U.S. PATENT DOCUMENTS

| | | | | |
|---|---|---|---|---|
| 3,315,387 | A * | 4/1967 | Heuser | 40/638 |
| 3,964,770 | A * | 6/1976 | Abildgaard et al. | 281/29 |
| 4,430,137 | A * | 2/1984 | Jones | 156/253 |
| 6,416,082 | B1 * | 7/2002 | Gayoso | 281/29 |
| 7,566,375 | B2 * | 7/2009 | Huang | 156/256 |
| 2004/0108709 | A1 * | 6/2004 | Hengsbach | 281/29 |
| 2006/0120828 | A1 * | 6/2006 | Kato | 412/3 |

FOREIGN PATENT DOCUMENTS

| | | |
|---|---|---|
| JP | 49-56727 | 6/1974 |
| JP | 63-41587 | 3/1988 |
| JP | 2003-205692 A | 7/2003 |
| JP | U-3101717 | 3/2004 |
| JP | 2004-358810 | 12/2004 |

* cited by examiner

METHOD OF CREATING BOOKLET COVER AND BOOKLET COVER KIT

RELATED APPLICATIONS

This application claims the priority of Japanese Patent Application No. 2005-109904 filed on Apr. 6, 2005, which is incorporated herein by reference.

FIELD OF THE INVENTION

This invention relates to the method for making a cover of a booklet and a kit for making a cover of a booklet which is from printing paper where the picture and the like are printed.

BACKGROUND OF TECHNOLOGY

The prevalence of digital cameras etc. has increased the enjoyment of electronic images photographed by the digital cameras etc. which has helped spread appreciation of image data on the monitor of a personal computer, or performance of editing this image data. The image data may be saved on an archival medium, such as a hard disk and a compact disk, or may be printed with a printer. Moreover, such image data may be printed in pasteboard or printing paper, and a book may be bound as an album made of paper, and it can be commemorated and it can be enjoyed, or it can be carried out. Compared with sticking a photograph in an album, it is a sensation to print an image directly in pasteboard or printing paper, bound as a book, and enjoyed. In order to create such an album wherein electronic image data is saved on an archival medium a specific contractor or bookbinding may be requested through the Internet to create an individual album for delivery.

However, in this way, in order to print and bind an image directly in pasteboard or printing paper, a vendor must be requested, where the process of making an order may be troublesome, or many days may be required to complete the order, and it is hard to say that an electronic image can be easily bound in an album made of paper. If the approach is taken of printing only an image and sticking the printed image on a ready-made album, an individual can perform this easily, but a cheap impression will result if compared with bookbinding. Given that photography has become possible by the spread of digital cameras, an approach of bookbinding those images easily is desired.

For expert or an individual use, JP 2004/358810 discloses printing paper which can create a booklet by having an image printed directly on pasteboard or on printing paper, and a book cover is disclosed for making the booklet easily and promptly. But there are problems and issues which are explained below.

A cover is often made from ready-made ones and it is not often possible to make made-to-order ones easily and promptly. The purpose of this invention is to disclose printing paper which can create the booklet by having an image directly printed on pasteboard or on printing paper, and to disclose a book cover that can make the booklet easily and promptly for expert or individual use.

SUMMARY OF THE INVENTION

In order to solve the above mentioned technical problems, the method for making a cover of a booklet is proposed below.

The booklet cover creation method has cover sheet and cover core components. The cover sheet is formed with a cover seal on which adhesion layer is formed on the reverse side and releasing paper is formed on the next layer of the adhesion layer. The releasing paper may be released from the cover seal. The releasing paper is formed with more than two cutting lines from the edge of one side to the other edge in a longitudinal direction.

The cover core components have a backbone component for a back cover of the booklet and a first cover component placed next to the backbone component with some space. The second cover component is placed to the opposite side of the first cover component and the framework-body component which can separate from the backbone component and the first cover component and the second cover component. A part of the releasing paper is peeled off and the cover sheet is placed on the first surface of the cover core components. The first cover component, the second cover component and the backbone component are adhered and fixed by the adhesive layer of the cover seal. The framework-body is taken off and the rest of the releasing paper is peeled off. The cover seal connects the first cover component and second cover component and backbone component and the outer area of cover seal is bent and overlapped on the cover components.

The booklet cover is created by using the cover sheet and the cover core components. The preprinted cover sheet is prepared and a part of the releasing paper of the preprinted cover sheet is peeled off. The cover sheet is placed on the first surface of the cover core components. The first cover component the second cover component and the backbone component are adhered and fixed by the adhesive layer of the preprinted cover seal. And it is possible to make a decoration on the surface of booklet cover by hand painting.

By the above-mentioned method, it is possible to make the booklet cover with a user selected color or painted picture, because the cover core components are connected using the adhesive layer of the cover sheet.

In order to solve the above mentioned technical problems, the method for making a cover of booklet is proposed below.

The booklet cover creation method has base sheet and cover core components and cover material for cover sheet. The base sheet is formed with a double-sided pressure sensitive sheet on which the first releasing paper is formed on the top layer of the first adhesion layer and the first adhesion layer is formed on the core sheet of the base sheet. The releasing paper may be released from the base sheet. The releasing paper is formed with more than two cutting lines from the edge of one side to the other edge in a longitudinal direction and on which the second releasing paper is formed on the bottom layer of the second adhesion layer. The second adhesion layer is formed on the reverse side of core sheet of the base sheet. The releasing paper is formed with more than two cutting lines from the edge of one side to the other edge in a longitudinal direction.

The cover core components have the backbone component for the back cover of booklet; the first cover component which is placed next to the backbone component with some space; the second cover component is placed to the opposite side to the first cover component; and the framework-body component which can be separated from the backbone component, the first cover component, and the second cover component.

A part of the first releasing paper is peeled off and the cover material for cover sheet is fixed partially on the base sheet. The rest of the releasing paper is peeled off and the cover material for cover sheet is fixed totally. And then after or before, a part of the second releasing paper is peeled off and the base sheet is placed on the first surface of the cover components. The first cover component, the second cover component and the backbone component are adhered and fixed partially by the adhesive layer of the base sheet with the cover material for cover sheet. The framework-body is taken off and rest of the releasing paper is peeled off.

The base sheet connects the first cover component; second cover component; and backbone component. Outer area of the base sheet with the cover material for cover sheet is bent and overlapped on the cover components. The booklet cover is created by using the base sheet; the cover material for cover sheet; and the cover core components. By the above-mentioned method, it is possible to make the booklet cover with user selected paper or cloth, because of the connection to the cover core components by using the adhesive layer of the double-sided pressure sensitive base sheet.

In the booklet cover creation method, the first cover component, the second cover component and the backbone component are adhered and fixed partially by the adhesive layer of the base sheet with the cover material for cover sheet. The framework-body is taken off and the four corners of the base sheet with the cover material for cover sheet is cut down and then, rest of the releasing paper is peeled off. The base sheet with the cover material for cover sheet connects the first cover component and second cover component and backbone component and outer area of the base sheet with the cover material for cover sheet is bent and overlapped on the cover components. By connecting the cover sheet and the base sheet and cutting down the four corners, it is easier to bend and overlap the base sheet on the cover component for the booklet cover.

In order to solve the above mentioned technical problems, the method for making cover of booklet is proposed below.

In the booklet cover creation kit in which the printable cover sheet is prepared, the cover sheet is formed with the cover seal on which adhesion layer is formed on the reverse side and the releasing paper is formed on the next layer of the adhesion layer. The releasing paper may be released from the cover seal. The releasing paper is formed with more than two cutting lines from the edge of one side to the other edge in a longitudinal direction. The cover core components have the backbone component for the back cover of booklet; the first cover component which is place to next of the backbone component with some space; the second cover component which is placed to the opposite side to the first cover component; and the framework-body component which can separate from the backbone component, the first cover component, and the second cover component.

A part of the releasing paper is peeled off and the cover sheet is placed on the first surface of the cover core components. The first cover component, the second cover component, and the backbone component are adhered and fixed by the adhesive layer of the cover seal. The framework-body is taken off and rest of the releasing paper is peeled off. The cover seal connects the first cover component, second cover component, and backbone component. The outer area of cover seal is bent and overlapped on the cover components.

The booklet cover is created by using the cover sheet and the cover core components. On the surface of the cover sheet, users can print whatever pattern or color that they like. Adhesive layer is formed on cover sheet and it is easily connected to the cover core components. Releasing paper on the adhesive layer is formed by more than two cutting lines, and it is possible to release a part of releasing paper. By removing remaining releasing paper, it is possible to connect the cover sheet may be connected to the first cover component, second cover component, and backbone component. To do the connection, it is possible to retry connecting the cover sheet and the core cover component because of weak adhesion if the placement is wrong.

After good placement with the cover sheet and the first cover component, second cover component, and backbone component, the outer area of the cover seal is bent and overlapped on the cover components. Releasing paper of the cover sheet has a center belt zone which is formed in center from the edge of one side to the other edge in a longitudinal direction and both sides of the center belt zone are the first side of the releasing paper and the second side of the releasing paper. Doing this formation and peeling off the releasing central belt zone paper makes soft connection with cover sheet to the first cover component and second component and backbone component. After good placement of cover sheet, the first side of releasing paper and the second side of releasing paper are peeled off and the cover sheet connects strongly to cover core components.

The booklet cover creation kit is recommended for use with the cover seal of which four corners of cover seal of the cover sheet are cut down. Using the seal, it is easier to bend and overlap to cover core components which are the first core component, second core component, and backbone component.

In order to solve the above mentioned technical problem, the method for making cover of booklet is proposed below.

The booklet cover creation kit has base sheet, cover core components, and cover material for a cover sheet. The base sheet is formed with a double-sided pressure sensitive sheet on which the first releasing paper is formed on the top layer of the first adhesion layer and the first adhesion layer is formed on the core sheet of the base sheet. The releasing paper may be released from the base sheet and on which a second releasing paper is formed on the bottom layer of a second adhesion layer. The second adhesion layer is formed on the reverse side of the core sheet of the base sheet. The releasing paper is formed with more than two cutting lines from the edge of one side to the other edge in a longitudinal direction.

The cover core components have the backbone component for the back cover of the booklet; the first cover component which is placed next to the backbone component with some space; the second cover component which is placed to the opposite side to the first cover component; and the framework-body component which can separate from the backbone component, the first cover component, and the second cover component.

A part of the first releasing paper is peeled off and the cover material for the cover sheet is fixed partially on the base sheet. The rest of the releasing paper is peeled off and the cover material for the cover sheet is fixed totally. And then after or before, a part of the second releasing paper is peeled off and the base sheet is placed on the first surface of the cover components. The first cover component, the second cover component and the backbone component are adhered and fixed partially by the adhesive layer of the base sheet with the cover material for the cover sheet. The framework-body is taken off and the rest of the releasing paper is peeled off.

The base sheet connects the first cover component, second cover component, and backbone component. The outer area of the base sheet with the cover material for the cover sheet is bent and overlapped on the cover components. The booklet cover is created by using the base sheet, the cover material for the cover sheet, and the cover core components.

Using the components and peeling off the first releasing paper, users can adhere the cover material for the booklet how they like. Adhesive layer is formed on the base sheet and it is easily connected to cover core components. The second releasing paper on the adhesive layer is formed by more than two cutting lines, and it is possible to release a part of releasing paper.

By removing remaining releasing paper the cover sheet may be connected to the first cover component, second cover component, and backbone component. To do the connection, it is possible to retry connecting the cover sheet and the core cover component because of soft adhesion if the placement is wrong. After the good placement with the cover sheet, the first cover component, second cover component, and backbone component, the outer area of cover seal is bent and overlapped on the cover components.

In order to solve the above mentioned technical problem, the method for making cover of booklet is proposed below.

The booklet cover creation kit has a base sheet, cover core components, and cover material for a cover sheet. The base sheet is formed with a double-sided pressure sensitive sheet on which the first releasing paper is formed on the top layer of the first adhesion layer and the first adhesion layer is formed on the core sheet of the base sheet. The releasing paper may be released from the base sheet. The releasing paper is formed with more than two cutting lines from the edge of one side to the other edge in a longitudinal direction and on which the second releasing paper is formed on the bottom layer of the second adhesion layer. The second adhesion layer is formed on the reverse side of core sheet of the base sheet. The releasing paper is formed with more than two cutting lines from the edge of one side to the other edge in a longitudinal direction.

The cover core components include the backbone component for the back cover of booklet; the first cover component which is placed next to the backbone component with some space; the second cover component which is placed to the opposite side to the first cover component; and the framework-body component which can separate from the backbone component, the first cover component, and the second cover component.

A part of the first releasing paper is peeled off; the cover material for cover sheet is fixed partially on the base sheet; the rest of the releasing paper is peeled off; and the cover material for cover sheet is fixed totally. And then after or before, a part of the second releasing paper is peeled off and the base sheet is placed on the first surface of the cover components. The first cover component, the second cover component and the backbone component are adhered and fixed partially by the adhesive layer of the base sheet with the cover material for the cover sheet. The framework-body is taken off and rest of the releasing paper is peeled off. The base sheet connects the first cover component, second cover component, and backbone component. The outer area of the base sheet with the cover material for the cover sheet is bent and overlapped on the cover components.

The booklet cover is created by using the base sheet, the cover material for cover sheet, and the cover core components. Using the components and peeling off the first releasing paper, users can adhere, the cover material for booklet how they like. Adhesive layer is formed on base sheet and it is easily connected to cover core components. The first releasing paper on the adhesive layer is formed by more than two cutting lines, and it is possible to release a part of releasing paper. It is possible to connect to base sheet easily because of soft adhesion.

Adhesive layer is formed on the base sheet and it is easily connected to cover core components. The second releasing paper on the adhesive layer is formed by more than two cutting lines, and it is possible to release a part of the releasing paper. By removing remaining releasing paper the cover sheet may be connected to the first cover component, second cover component, and backbone component. To do connection, it is possible to retry connecting the cover sheet and the core cover component because of soft adhesion if the placement is wrong. After the good placement with the cover sheet, the first cover component, second cover component, and backbone component, the outer area of cover seal is bent and overlapped on the cover components.

The booklet creation kit is designed so that the first releasing paper of the double-sided pressure sensitive base sheet has a center belt zone which is formed in the center from the edge of one side to the other edge in a longitudinal direction and both sides of the center belt zone are the first side of the releasing paper and the second side of the releasing paper. Using the formation, it is possible to make soft adhesion with the base sheet and booklet cover sheet by peeling off the center belt zone releasing paper. After making good placement with base sheet and booklet cover sheet, and peeling off the first side releasing paper and second side releasing paper, it is possible to make hard adhesion with base sheet and booklet cover sheet.

The booklet creation kit is designed so that the second releasing paper of the double-sided pressure sensitive base sheet has a center belt zone which is formed in center from the edge of one side to the other edge in a longitudinal direction and both sides of the center belt zone are the first side of the releasing paper and the second side of the releasing paper.

Using the formation, it is possible to make soft adhesion with the base sheet and cover core components by peeling off the center zone releasing paper. After making good placement with base sheet and cover core components, and peeling off the first side releasing paper and second side releasing paper, it is possible to make hard adhesion with base sheet and cover core components.

The booklet creation kit is designed so that the cover sheet is installed for the purpose of adhesion to the double-sided pressure sensitive base sheet.

If a multi-booklet cover is installed, users can select the cover that they like and make a favorite booklet cover.

The booklet creation kit is designed so that a double-sided pressure sensitive base sheet is formed with four cutting lines for cut down. Using the formation, it makes it easier to bend and overlap. After the good placement with the cover sheet, the first cover component, second cover component, and backbone component, the outer area of the cover seal is bent and overlapped on the cover components.

The booklet creation kit is designed so that the double-sided pressure sensitive auxiliary materials are installed with the first releasing paper is formed on the top layer of the first adhesion layer; may be released from the base sheet; and is formed largely in longitudinal direction. The second releasing paper is formed on the top layer of the second adhesion layer and may be released from the base sheet. And the second releasing paper is peeled off and is connected to the booklet cover. Then the first releasing paper is peeled off and connected to printing paper which is printed and folded into a booklet. Using the formation, it is possible to make good hard adhesion with folded printing paper and booklet cover.

EMBODIMENT OF THE INVENTION

By referring the figure, the form of this invention is explained.

Execution Example 1

Figure 1A:
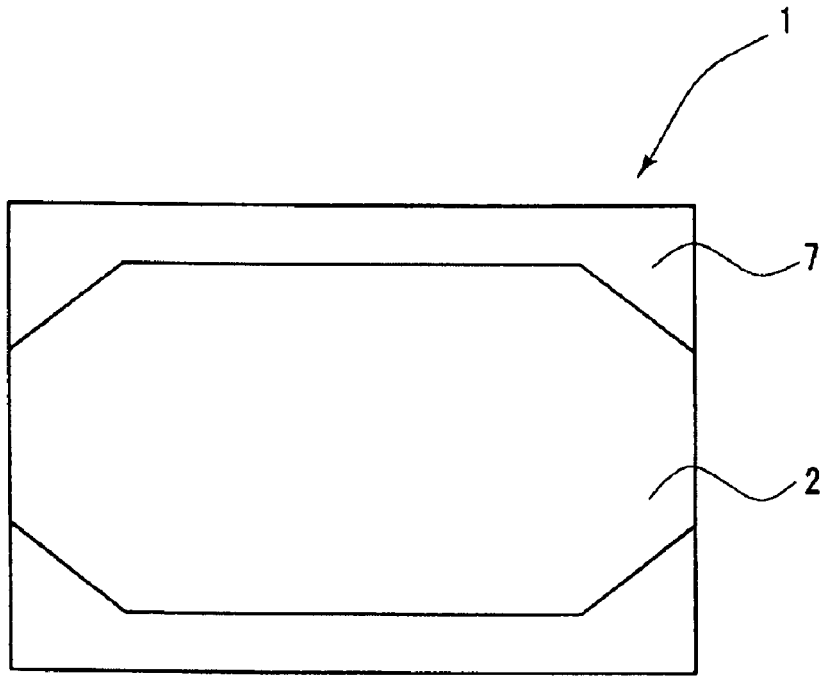
FIG. 1A The front surface of booklet cover sheet
Figure 1B:
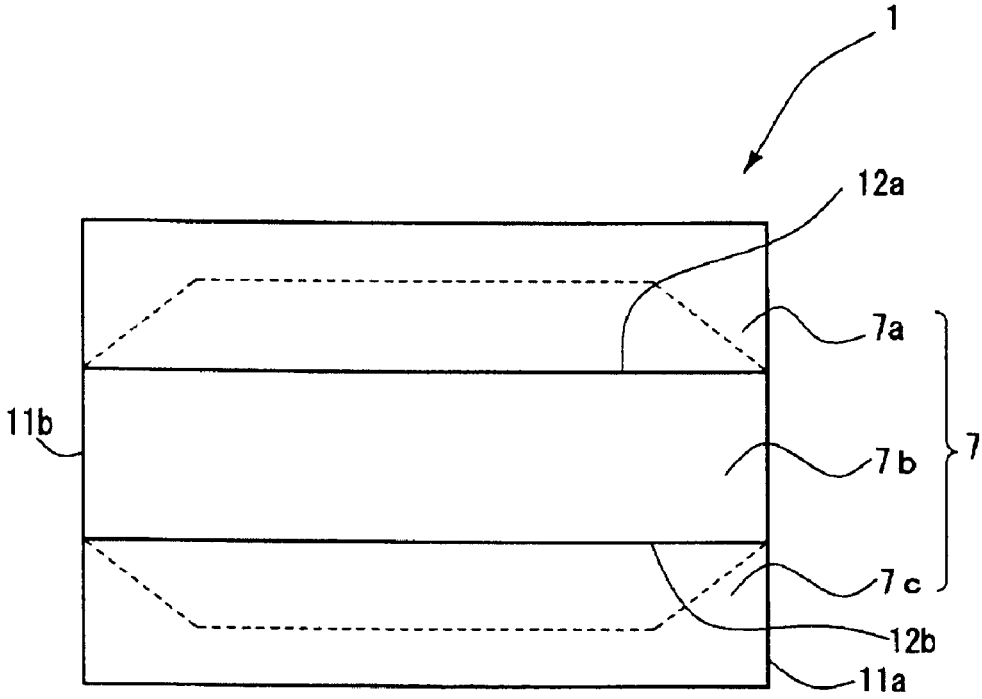
FIG. 1B The rear surface of booklet cover sheet

FIG. 1 is the booklet cover sheet 1 of this invention. FIG. 1A is the surface of booklet cover sheet 1. The booklet cover sheet 1 is formed by cover seal 2 on which the rear side is adhesive layer 3 (see FIG. 2). In addition to adhesion layer 3, there is the seal 2 and releasing paper 7. The surface of cover seal 2 is ready to print by inkjet printer. FIG. 1B is the rear face of cover sheet 1. The total rear face of cover sheet 1 is formed by releasing paper 7. The releasing paper 7 is formed by central belt zone 7*b* which is formed in center from the edge of one side 11*a* to the other edge 11*b* in a longitudinal direction and both sides of the center belt zone 7*b* are the first side of the releasing paper 7*a* and the second side of the releasing paper 7*c*. The releasing paper 7 is formed into 3 zones by cutting line 12*a* and 12*b*.

Figure 2:
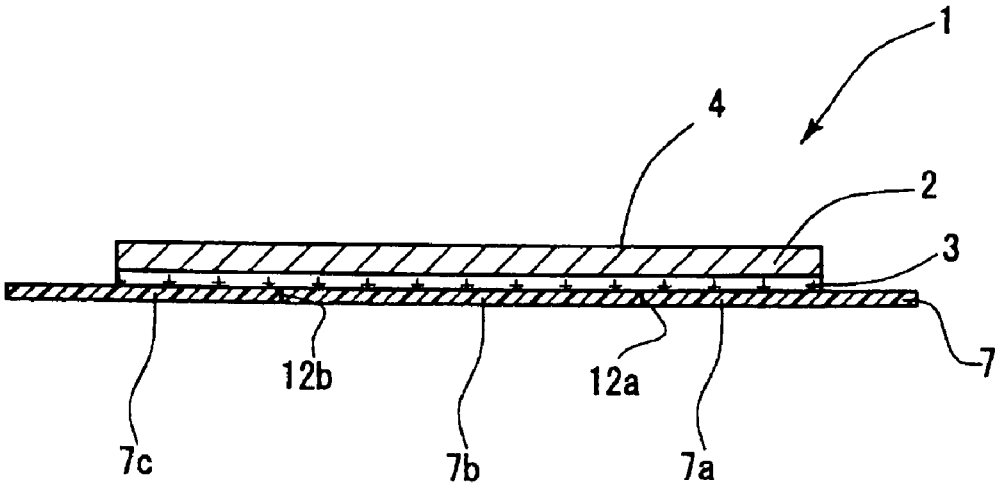
FIG. 2 Cross section of booklet cover sheet

FIG. 2 is the cross section of cover sheet 1. Adhesive layer is formed at the rear face of cover seal 2. In addition to the adhesion layer 3, there is the releasing paper 7. The releasing paper 7 is formed into 3 zones—the first side releasing zone 7*a*, center zone 7*b*, second zone 7*c*—by cutting line 12*a* and 12*b*. The cover seal 2 which is formed on cover sheet 1 is useful for printable surface 4. It is possible to make printing on the surface of cover seal 2 on which the cover sheet 1 is put into the inkjet printer. Printing is done by general usage software. Users can get the good pattern and good color that they like.

Figure 3:
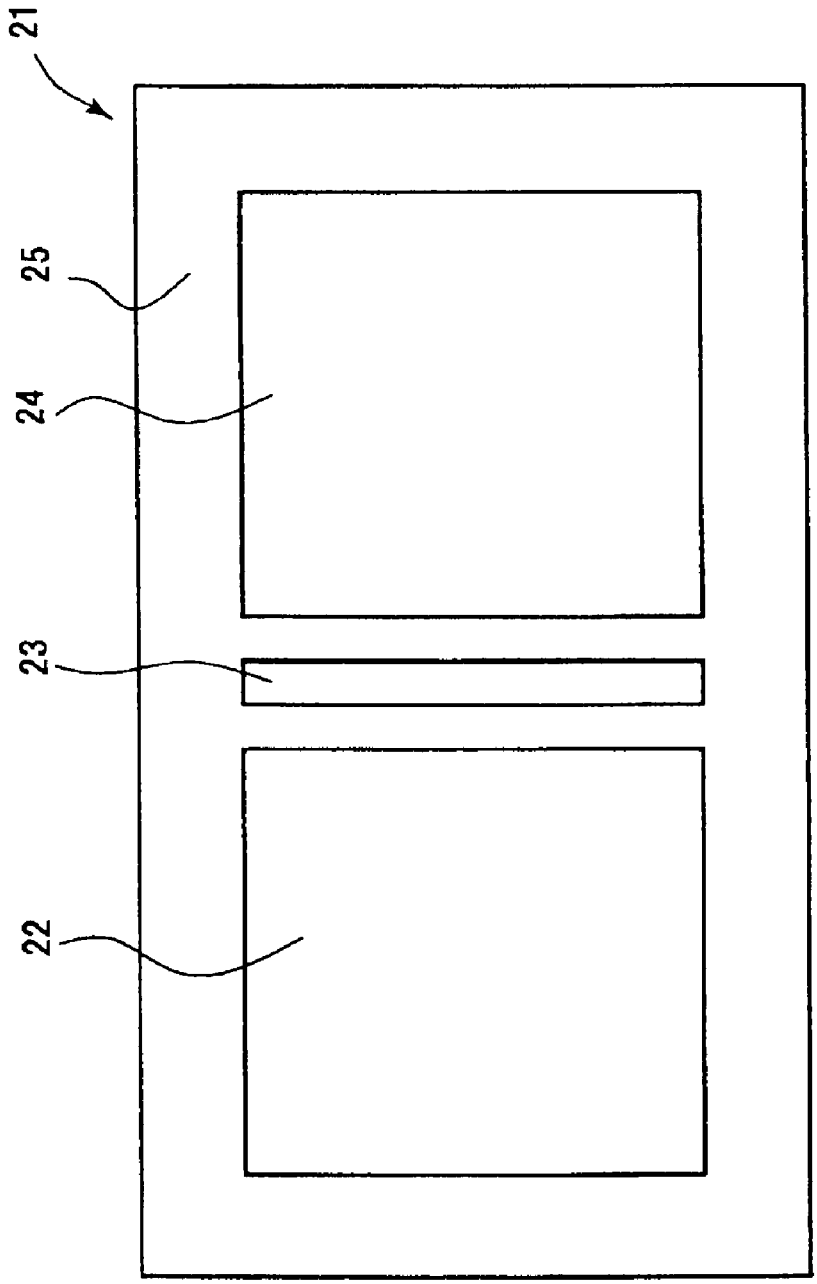
FIG. 3 Cover core components

FIG. 3 is the cover core components 21. By stamping and paper material, the cover core components 21 form the frame-body 25 which is possible to remove from other components, first cover component 22, back-bone core component 23, and second core component 24. The first cover component 22, back-bone component 23, and second core component 24 are maintained at a specified interval or distance. First core component 22 and second core component 24 are stamped at the same size and they become the front cover and rear cover of the booklet.

The first core component 22, back-bone core component 23, and second core component form the booklet cover. It is recommended to have good hardness, strength and thickness. It is not restricted to use paper only for cover core components 21. It is possible to use other materials like plastics and metals by molding or by punching.

The cover sheet 1 and cover core components 21 are designed to be the same size when stamped. This is very good for making positioning and adhesion with cover sheet 1 and cover core components 21 as explained later.

Figure 4A:
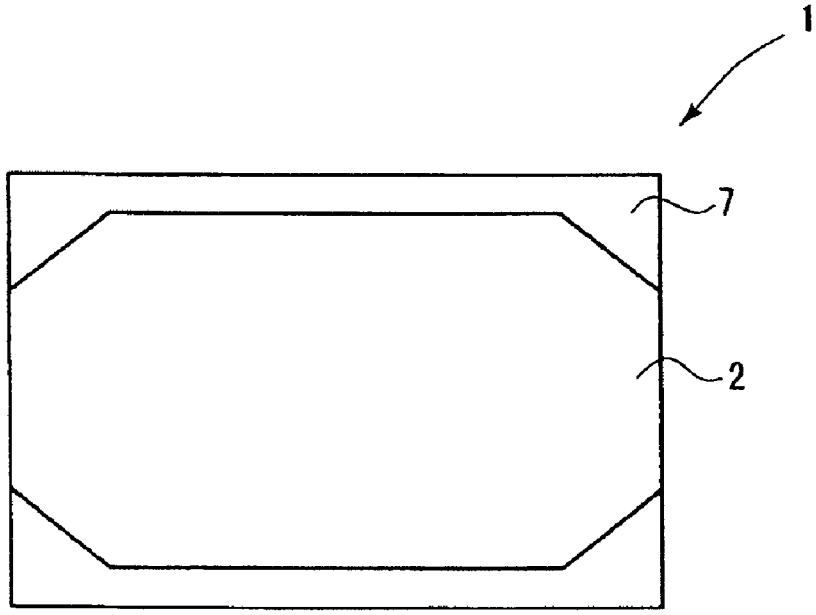
FIG. 4A Assemble process of booklet cover using cover sheet
Figure 4B:
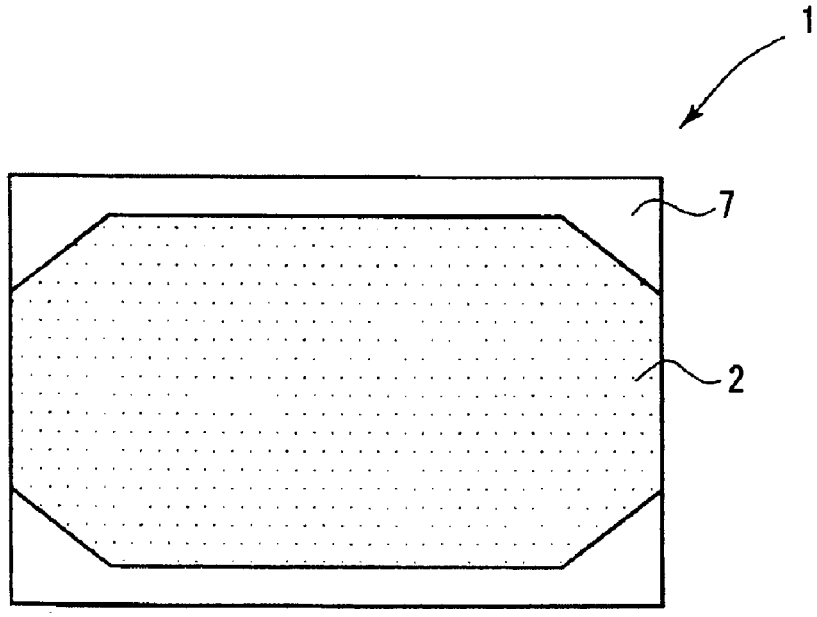
FIG. 4B The process of succeeding FIG. 4A
Figure 4C:
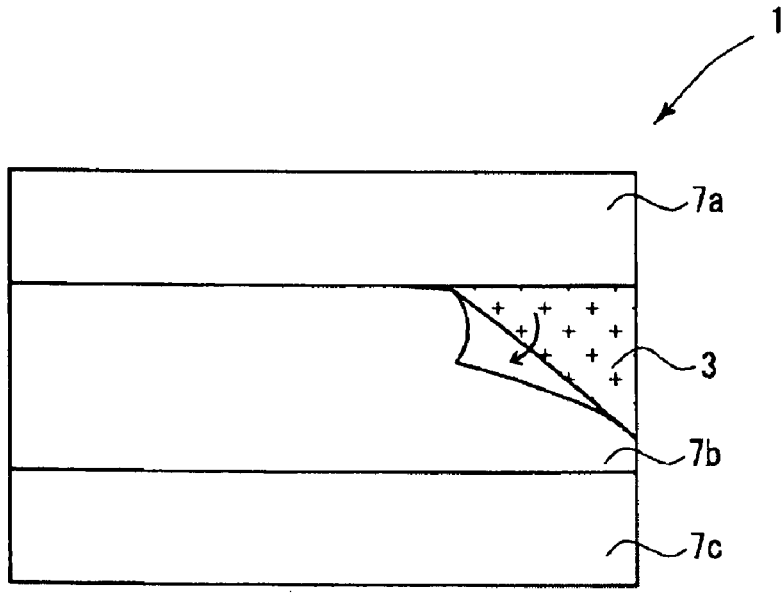
FIG. 4C The process of succeeding FIG. 4B

FIG. 4, FIG. 5, and FIG. 6 explain the assembly process of a booklet cover 20. The cover sheet 1 and cover core component 21 which are included in the booklet cover kit are prepared. FIG. 4A shows that the cover seal 2 on the cover sheet 1 is not printed and is a solid color. Cover seal 2 on the cover sheet 1 is printed how you like by inkjet printing, handwriting, or hand painting in FIG. 4B. FIG. 4C shows the picture of releasing the center zone releasing paper 7*b* of releasing paper 7 that is on the rear side of the cover sheet 1. The adhesion layer 3 of the center zone is exposed.

Figure 5A:
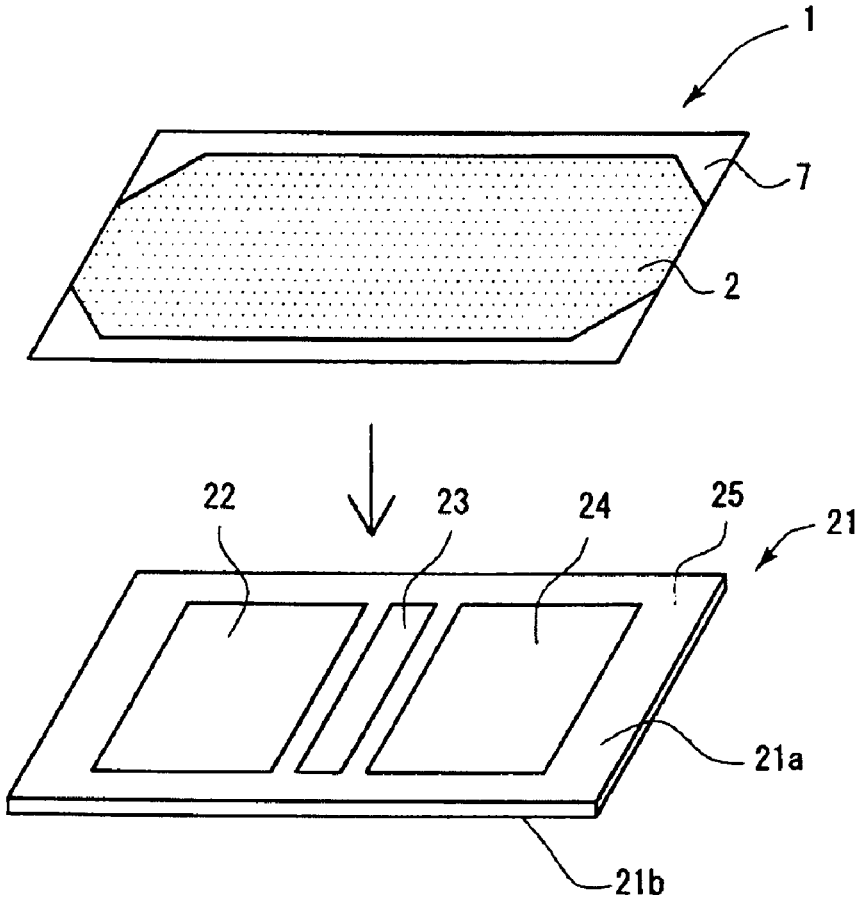
FIG. 5A The process of succeeding FIG. 4C

And FIG. 5A shows that the cover sheet 1 on which the adhesion layer 3 of the center zone is exposed is placed down on the cover core components 21*a* which is the front side of cover core components 21. It is easy to position the corner of cover sheet 1 with cover core components which is designed at same size. Using center zone of the exposed adhesion layer 3, the cover sheet 1 is connected with cover core components 21. It is easy to make re-connection if the placement of the cover sheet 1 and the cover core components 21 is wrong, because of the partial usage of adhesion layer 3.

Figure 5B:
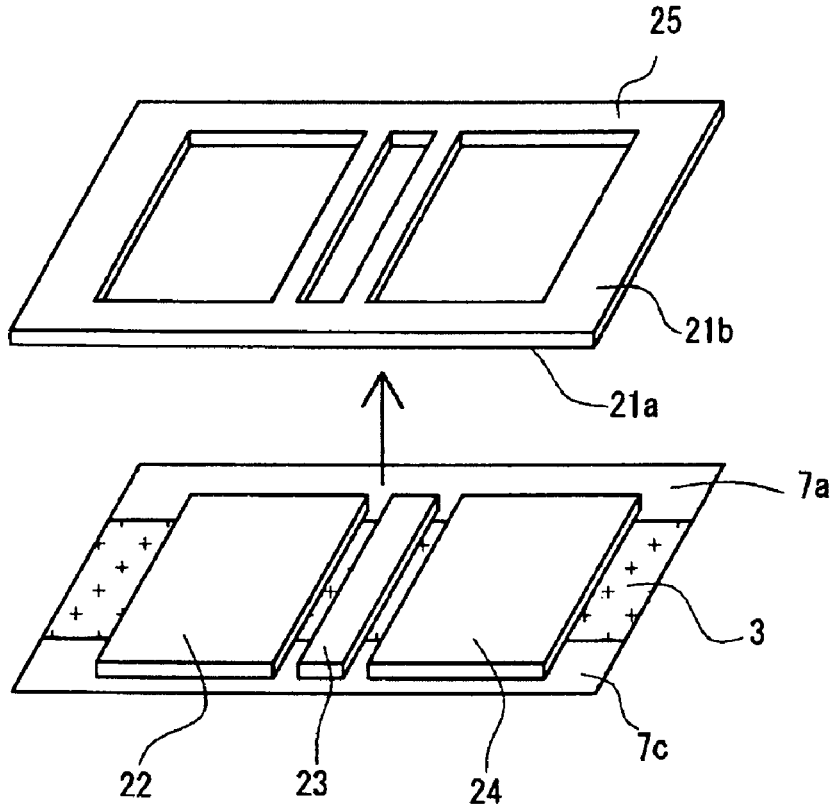
FIG. 5B The process of succeeding FIG. 5A

FIG. 5B shows that the adhesion layer 3 of the cover sheet 1 has made a soft connection with first cover core component 22, back-bone core 23, and second core component 24. After the good placement and good connection, the core frame 25 of the cover core components is taken off from the second side of cover core components 21.

Figure 6A:
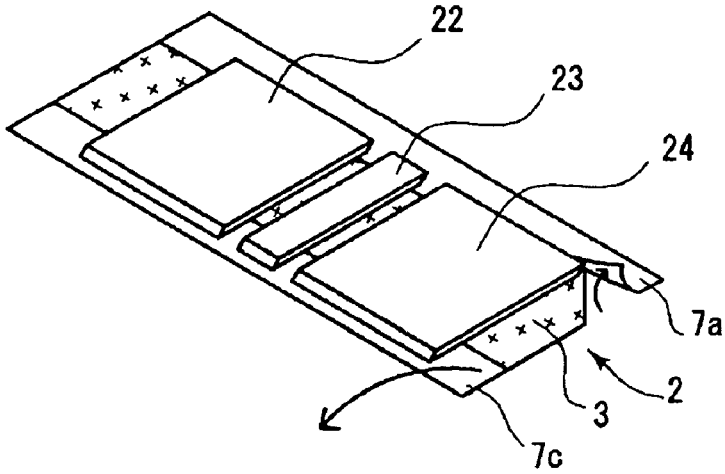
FIG. 6A The process of succeeding FIG. 5B

And FIG. 6A shows that the adhesive layer 3 of the cover sheet 1 from which the first side of releasing paper 7*a* and second side of releasing paper 7*c* is peeled off makes a hard connection with cover core component 22, back-bone core 23, and second core component 24 of cover core components.

Figure 6B:
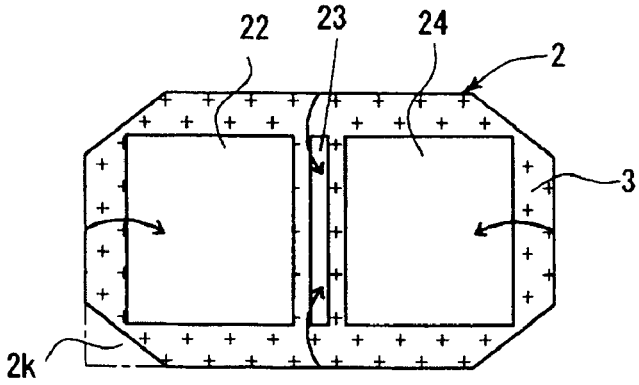
FIG. 6B The process of succeeding FIG. 6A
Figure 6C:
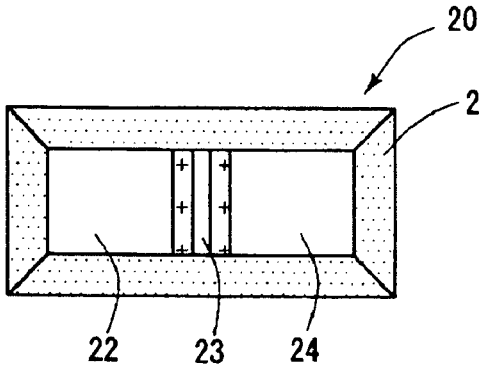
FIG. 6C The process of succeeding FIG. 6B

FIG. 6B shows how the outer area of cover seal is bent to the inside. FIG. 6C shows the finished product of booklet cover 20. The four corner 2*k* of the cover seal 2 is cut and makes it easy to bend from outside to inside of the outer cover area seal 2.

The cover sheet 1 is very good for coloring or decoration by inkjet printer or other printing technologies. It is very easy to get the booklet cover 20 how the user likes.

Execution Example 2

Figure 7A:
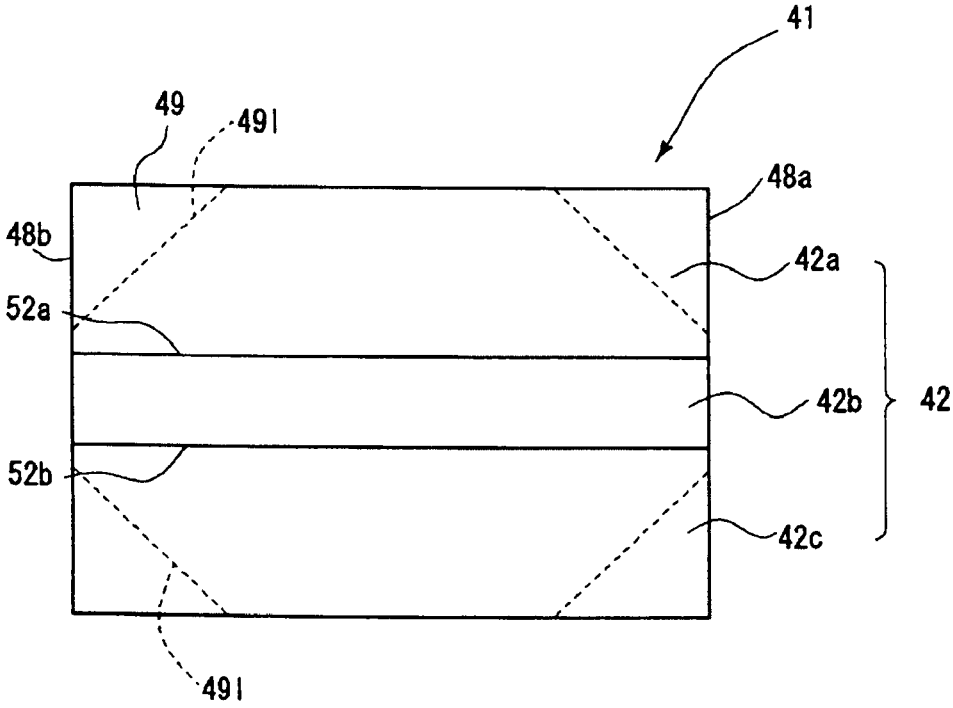
FIG. 7A The front surface of both side adhesive pressure sensitive sheet
Figure 7B:
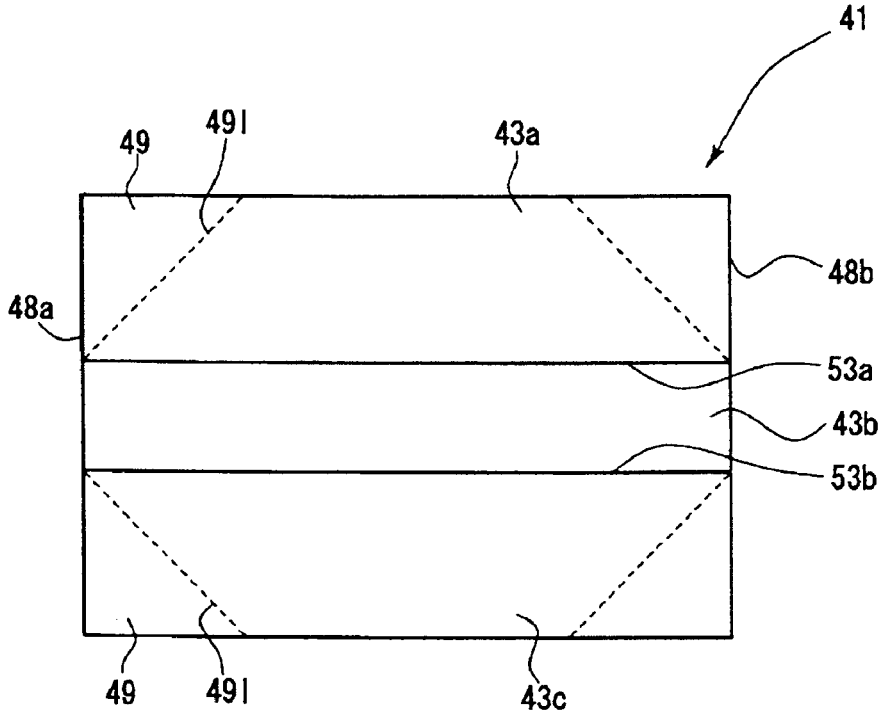
FIG. 7B The rear surface of both side adhesive pressure sensitive sheet
Figure 8:
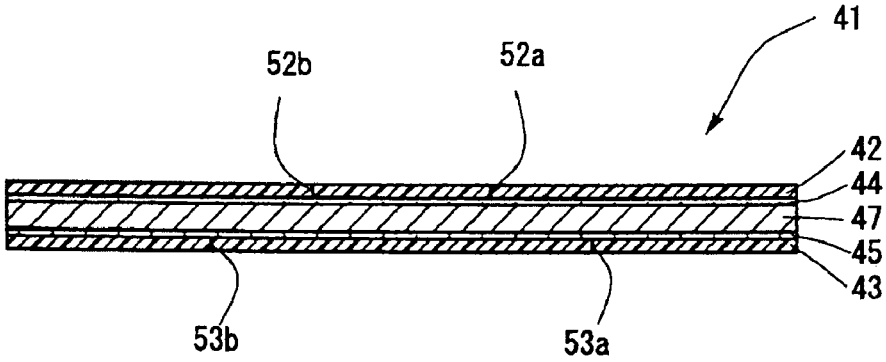
FIG. 8 Cross section of both side adhesive pressure sensitive sheet

FIG. 7 and FIG. 8 show the double-sided pressure sensitive sheet 41 of this invention. FIG. 7A is the front surface of the sheet 41, FIG. 7B is the rear surface of the sheet 41, and FIG. 8 is the cross section of the sheet 41. The sheet has the base sheet 47, first adhesive layer 41, and the second adhesive layer. In addition to the double-sided adhesive layer 44 and 45, first releasing paper 42 is on front side of base sheet and second releasing paper is on rear side of base sheet. FIG. 7A shows the front surface first releasing paper 42 of double-sided pressure sensitive sheet 41. The releasing paper 42 is formed by the central belt zone 42*b* which is formed in center from the edge of the side 42*a* to the other edge 42*c* in the longitudinal direction and both sides of the center belt zone 42*b* are the first side of the releasing paper 42*a* and second side of the releasing paper 42*c*. The releasing paper 42 is formed of 3 zones by cutting line 52*a* and 52*b*. FIG. 7B shows the rear surface second releasing paper 43 of double-sided pressure sensitive sheet 41. The releasing paper 43 is formed by the central belt zone 43*b* which is formed in center from the edge of the side 43*a* to the other edge 43*c* in the longitudinal direction and both sides of the center belt zone 43*b* are the first side of the releasing paper 43*a* and second side of the releasing paper 43*c*. The releasing paper 43 is formed of 3 zones by cutting line 53*a* and 53*b*. The corner area of double-sided pressure sensitive sheet 41 is formed by cut off line 491 to take off from the double-sided pressure sensitive sheet. The cut off lines 491 are made by dotted lines of perforation.

On the formed double-sided pressure sensitive sheet 41, the surface which is covered with the first surface of releasing paper 42 becomes adhesive surface with cover sheet 58, and the surface which is covered with the second releasing paper 43 becomes adhesive surface with cover core components.

Figure 9A:
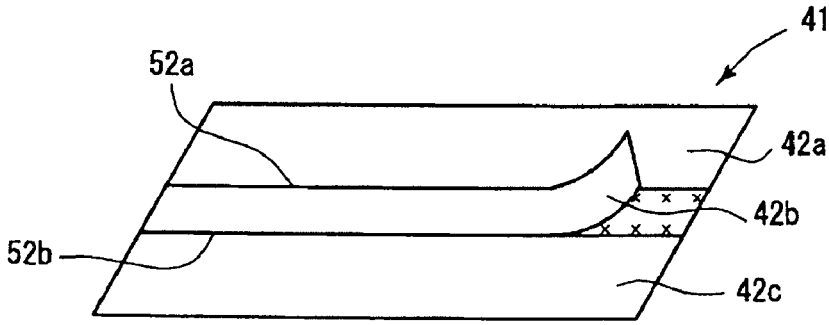
FIG. 9A Assemble process of booklet cover using both side adhesive pressure sensitive sheet FIG. 9B The process of succeeding FIG. 9A FIG. 9C The process of succeeding FIG. 9B FIG. 10A The process of succeeding FIG. 9C FIG. 10B The process of succeeding FIG. 10A FIG. 10C The process of succeeding FIG. 10B FIG. 11A The process of succeeding FIG. 10C FIG. 11B The process of succeeding FIG. 11A FIG. 11C The process of succeeding FIG. 11B FIG. 11D The process of succeeding FIG. 11C FIG. 12A The execution sample of printing paper FIG. 12B The execution sample of rear side of printing paper FIG. 13 Cross section of printing paper and explanation of bending line FIG. 14A The process of printing paper after printing FIG. 14B The process of succeeding FIG. 14A FIG. 15A The process of succeeding FIG. 14B FIG. 15B The process of succeeding FIG. 15A FIG. 15C The process of succeeding FIG. 15B FIG. 16A The explanation of peeling of releasing paper FIG. 16B The tab portion of peeling FIG. 17A The explanation of auxiliary sheet FIG. 17B Cross section of auxiliary sheet FIG. 18A The side view of booklet cover FIG. 18B The adhesion with assembled printing paper and booklet cover FIG. 18C The finish of booklet
Figure 9B:
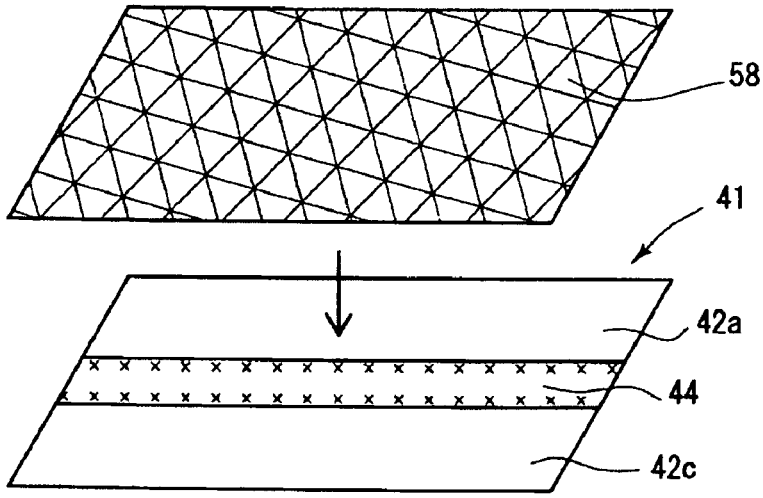
Figure 9C:
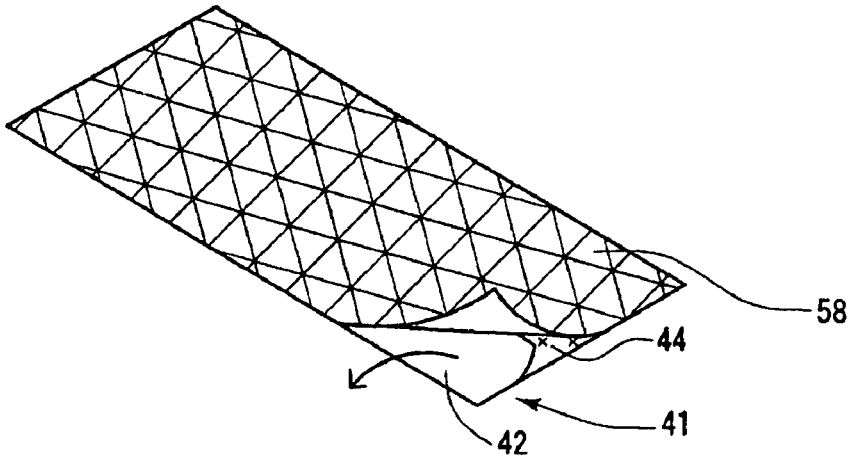

FIG. 9, FIG. 10, and FIG. 11 explain the assembly process of a booklet cover 20. The double-sided pressure sensitive sheet 41, cover sheet 58, and cover core components 21 which is included in the booklet cover kit are prepared.

FIG. 9A shows the picture of releasing the center zone releasing paper 42*b* of the first releasing paper 42 that is on the surface of the double-sided pressure sensitive sheet. FIG. 9B shows that the cover sheet 58 is placed down on the double-sided pressure sensitive sheet 41 and makes soft connection with adhesive layer 44.

The cover sheet 58 is a decorative booklet cover surface. Any preferred color or design may be used and also the material of cover sheet 58 may be paper, vinyl, cloth, leather, etc. It is easy to arrange the cover sheet 58 and cover core component 21 since they are the same size. It is possible to reposition placement of the cover sheet 58 on the double-sided pressure sensitive sheet 41 and connect again because of the soft connection of adhesive layer 44.

Adhesive layer 44 is used in a partial area. After repositioning, if there is no problem, the cover sheet 58 is hard adhered with the double-sided pressure sensitive adhesive sheet 41 after peeling off the first side of releasing paper 42*a* and the second side of releasing paper 42*c* releasing paper of the first releasing paper.

The first releasing paper 42 is accepted without cutting lines 52*a* and 52*b*. The releasing paper is used as one sheet, but when taking off the releasing paper, all of adhesive layer 44 is active. Making placement with cover sheet 58 and the double-sided adhesive pressure sensitive sheet 41 is difficult and after the wrong placement, it is very difficult to take off and make replacement. It is better that the releasing paper 42 have more than two releasing paper areas.

Figure 10A:
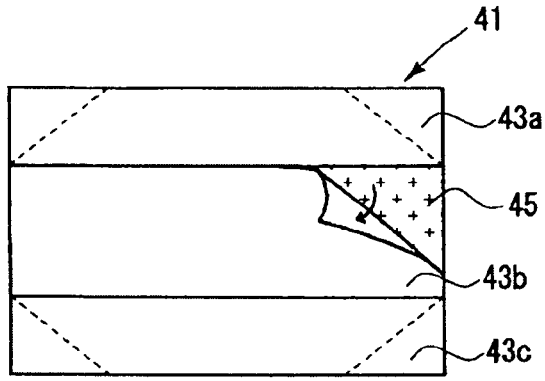
Figure 10B:
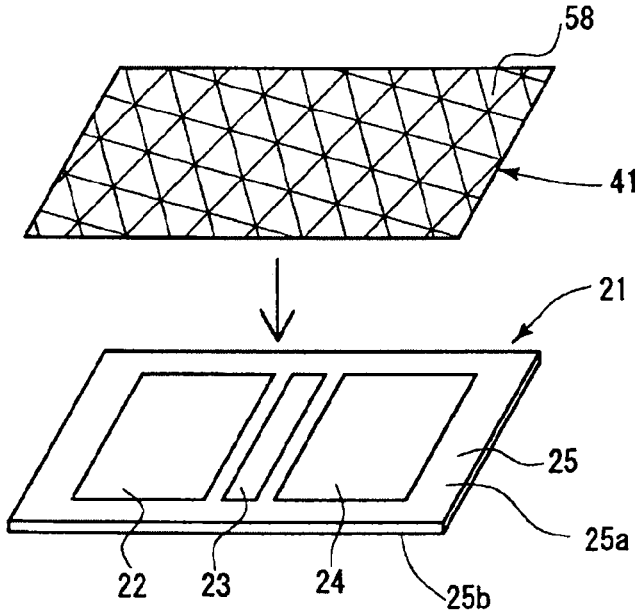

FIG. 10A shows the rear side of the double-sided adhesive pressure sensitive sheet 41. The center area of adhesive layer 45 is exposed by peeling off the center belt zone releasing paper 43*b* of the rear side of releasing paper of the double-sided adhesive pressure sensitive sheet 41. FIG. 10B shows the picture of releasing the center zone releasing paper 45 placing down the double-sided adhesive pressure sensitive paper 41 on the first side 21*a* of cover core components 21. These cover core components are as same as the execution 1. The double-sided adhesive pressure sensitive sheet 41 and cover core components are soft connected by exposed adhesive layer 45.

Figure 10C:
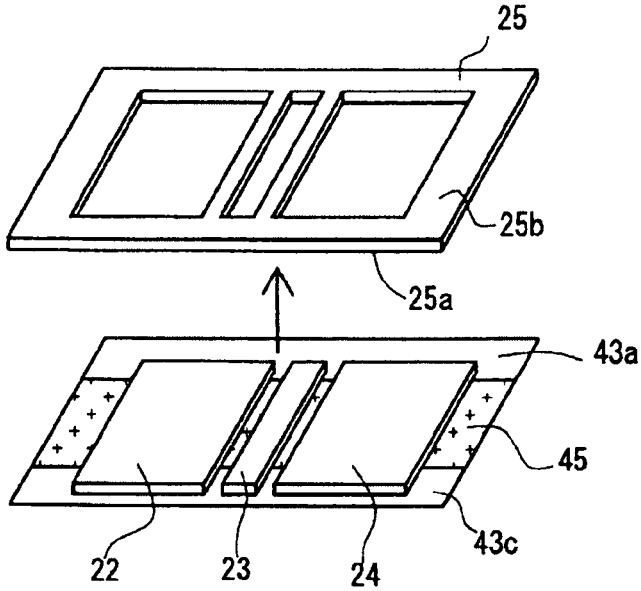

FIG. 10C shows the picture of soft adhesion of the double-sided adhesive pressure sensitive paper 41 and the first core 22, back-bone core 23, and second core 24 of cover core components 21. Then the frame cover component 25 of the cover core components 21 is removed from the cover core components 21. It is possible to make adhesion with the booklet cover with the double-sided adhesion pressure sensitive sheet which is adhered with cover core components first.

Figure 11A:
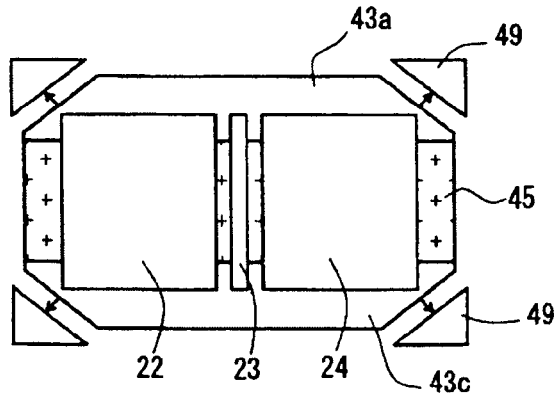
Figure 11B:
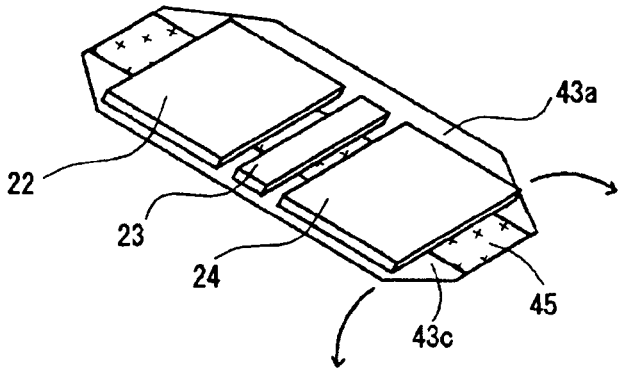

FIG. 11A shows the removal of the corner 49 from cutting line 491. It is easier if coversheet has the cutting lines on the same corners. FIG. 11B shows the picture of adhesion of the double-sided adhesive pressure sensitive sheet 41 and the first cover core component 22, back-bone core component 23, and second core component 24 of cover core components 21 after the releasing of the first side releasing paper 43*a* and second side of releasing paper 43*c* of second releasing paper 43 of the double-sided adhesive pressure sensitive sheet 41.

Figure 11C:
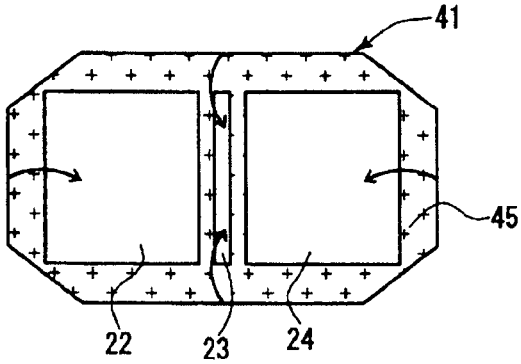

FIG. 11C shows that the four corners of the double-sided adhesive pressure sensitive sheet are cut and bent from outside to inside of the outer cover area.

Figure 11D:
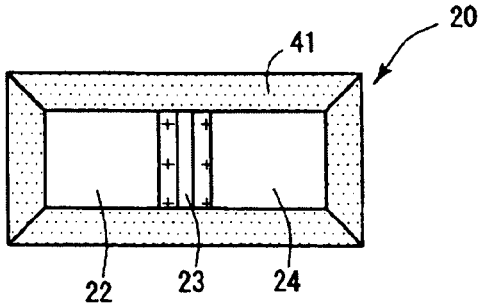

FIG. 11D shows the finished product of booklet cover 20.

Figure 12A:
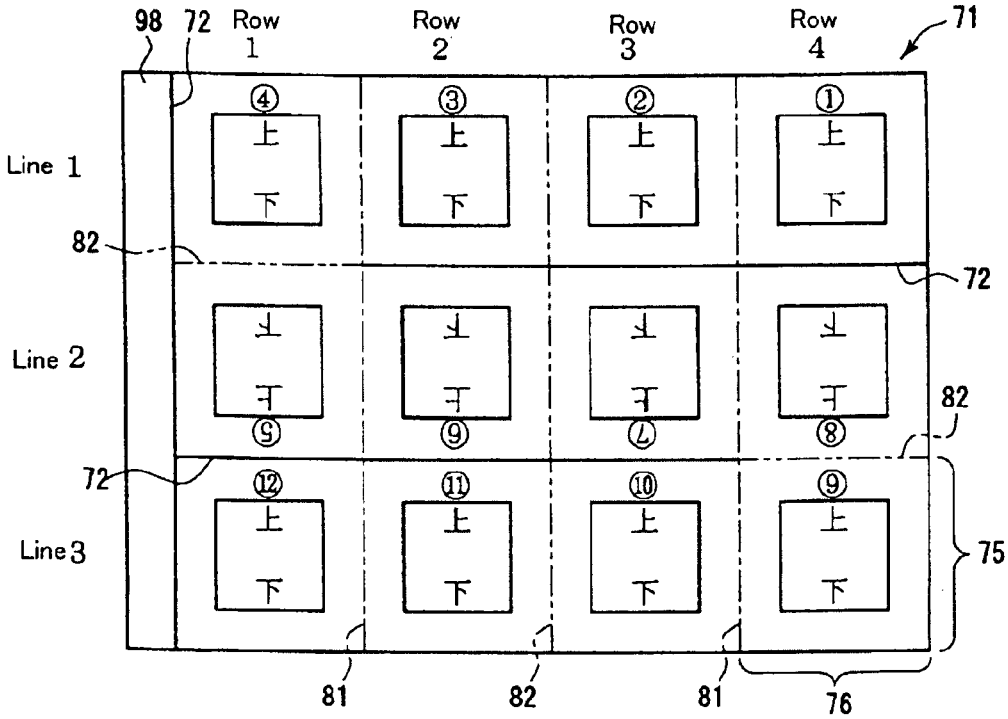
Figure 12B:
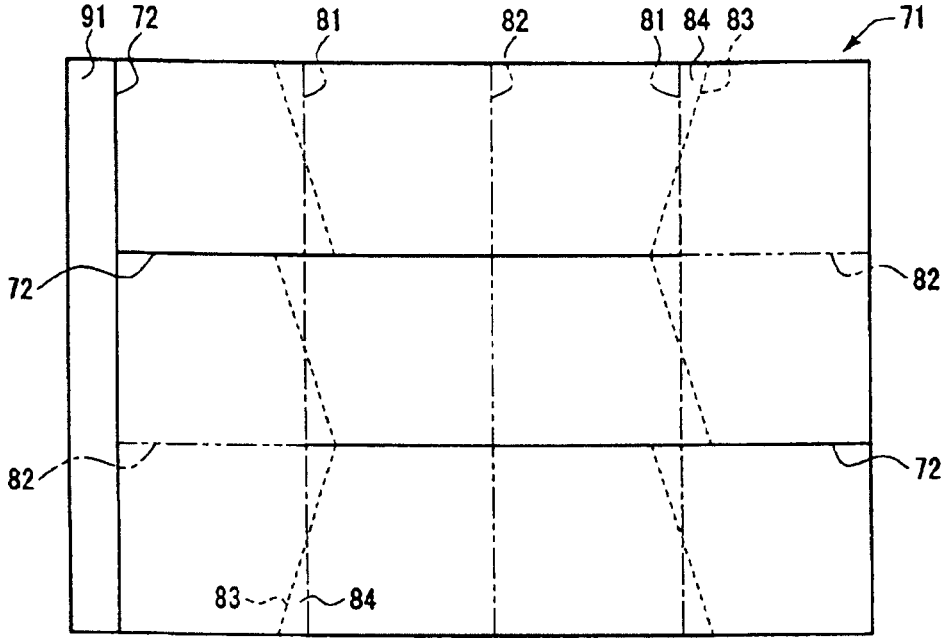

Booklet cover which is made by the execution example 1 or 2 is used for cover of process below. FIG. 12A and FIG. 12B show execution sample of printing paper by which is made the album booklet. FIG. 12A shows the front surface of printing paper 71. The page area of identical size into 3 lines 4 rows has lined up into the printing paper 71. The solid lines between 1st line and second line, from the left 2nd row to 4th row, from between 2nd line and 3rd line, from left 1st row to 3rd row show the cutting lines 72. Number is marked from 1st line 4th row. "Fold away from you" line 81 is formed between the 1st page and the 2nd page. "Fold toward you" line 82 is formed between 2nd page and 3rd page. Alternately "Fold away from you" line 81 and "Fold toward you" line are formed. Printing paper 71 is A4 size and less than 12 pages of pictures is printed. The printing paper is not limited to only this A4 size.

The position of images are decided and the direction of the images are decided which is shown in FIG. 12A on the printing. Each image from the 1st page to the 4th page and from 9th page to the 12th page is printed in the same direction. From the 5th page to the 8th page, images are printed in the reverse direction. The order of printing is done in the order of showing. If users select the print form and appoint the order of printing, it is not necessary to do detailed setting of printing position or other settings. Application software takes care of these settings and forwards the printing data to the printer and the data is printed on the printing paper.

The printing paper is A4 size and arranged with the 12 pages with 4 rows of 3 lines. Each page is formed with a square. The high quality imagination of the booklet comes from the square or near square image (75 and 76 is same length in FIG. 12A). Rest of page area 98 is shown FIG. 12A.

Figure 13:
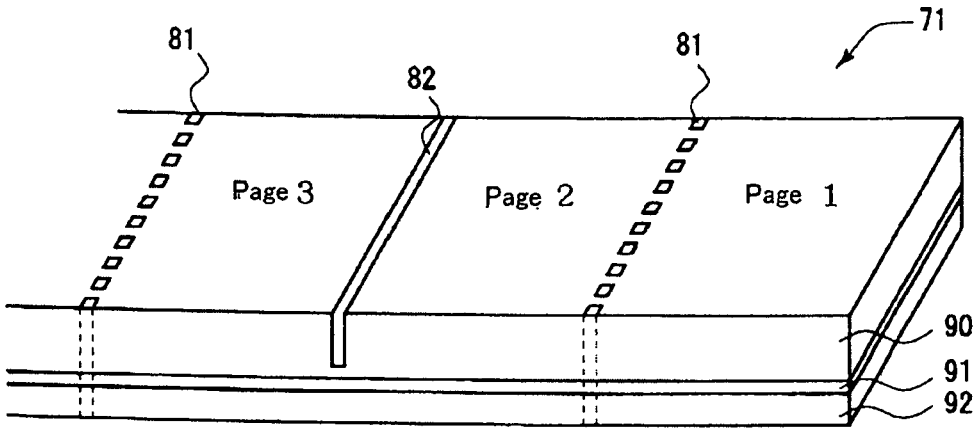

The next paragraph FIG. 13 describes a sectional structure of printing paper 71, and the "Fold toward you" line and the "Fold away from you" line formed between every adjacent row. Printing paper 71 comprises a sheet 90 with page regions having a adhesive layer 91 on the back surface thereof and releasing paper 92 placed thereon.

Use of a glossy photo paper as sheet 90 can ensure a fine finish of printing. The use of relatively thick product, as thick as 180 μm for example, is preferable in terms of producing a touch of high quality. It is to be understood that the drawing emphasizes the direction of thickness.

As shown in FIG. 13, "Fold away from you" line 81 is given as a perforation line, "Fold toward you" line 82 is given as a half-slit. The half-slit is formed as cutting sheet 90 to a depth of half or ⅔ of the depth-wise direction thereof, allowing the residual depth to remain connected. In other word, it has a bottomed trenched structure. This facilitates the folding. It is also allowable to give the perforation line as the "Fold toward you" line, and to give the half-slit as the "Fold toward you" line. It is still also allowable to give the perforation line as a micro-perforation line, so as to ensure cutting at the micro-perforation line when the printed paper is "Fold toward you" at the micro-perforation line. This ensures a good looking booklet having a relatively large number of pages.

The cover and rear surface can be bonded with each other by peeling off the releasing paper 92 from the rear surface. Releasing paper 92 is formed therein a release-assist formation line 83 which is cutting line and cross to perforation line or half-slit line and which facilitates the peeling of releasing paper 92. A weak adhesive agent composing adhesive layer 91 is preferable to enable re-peeling. In the case where printing paper 80 having a base weight 100 gr/m$^2$ or more and a thickness of 180 μm or more is used, usage of a adhesive having a tackiness of 12 Newton/25 mm or less allows peeling-off and re-adhesion, even if the position of bonding has to be shifted to a good position during the bonding process.

Referring back to FIG. 12B, the rear surface of printing paper is explained. The rear surface of printing paper is covered with releasing paper 92 (see FIG. 13). Releasing paper 92 has a releasing-assist formation line 83 therein. As shown in FIG. 12B, releasing-assist formation line 81 is diagonally formed as extending from "Fold away from you" line 81. Releasing-assist formation line 83, "Fold away from you" line 81, and the edges of the printing paper or cutting line 72 form the tab portion 84. Releasing-assist formation is a slit formed on releasing paper 92, and is not formed on 15 printing paper 90.

Figure 14A:
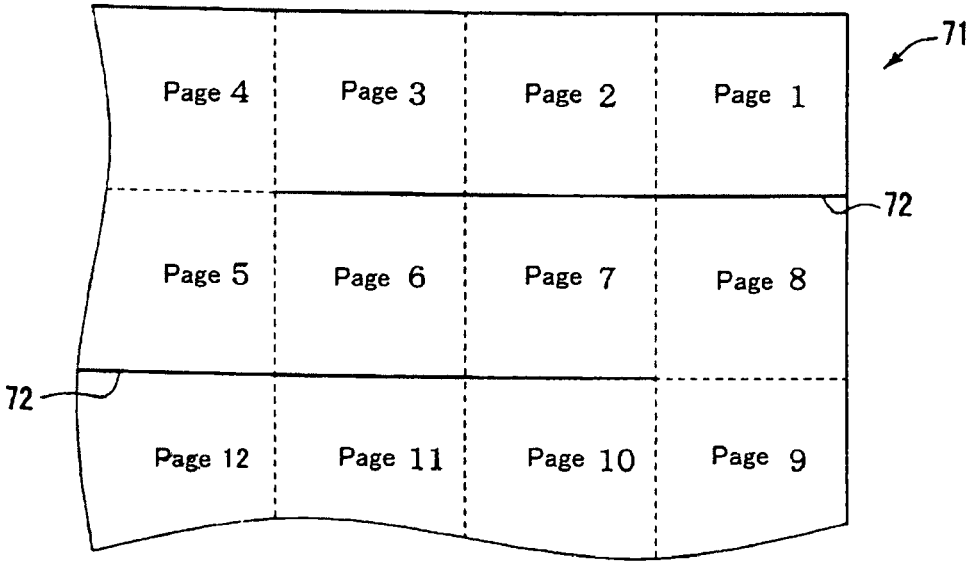
Figure 14B:
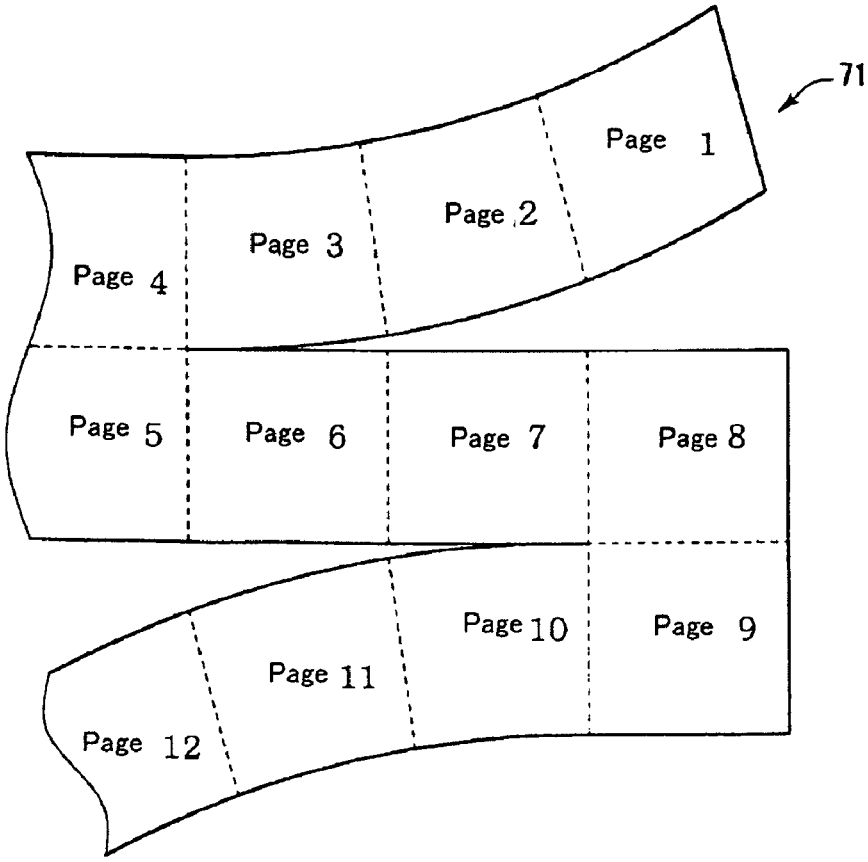

After printing, cutting line 72 of printing paper 71 which is expressed by the solid line shown in FIG. 12A is cut. The portion expressed by the dotted line is not cut. By folding the portions expressed by the dotted line in "Away from you" and "Toward you", an album booklet can be obtained which has the images printed therein according to predetermined order. FIG. 14A and FIG. 14B show the cutting between each page areas.

The cutting line 72 is formed in FIG. 14A. After printing the picture or photo, etc, on the printing paper 71, cutting line 72 is cut as shown in FIG. 14B. FIG. 14B shows the cutting is performed by cutting lines which is formed between first line and second line, between second line and third line.

Figure 15A:
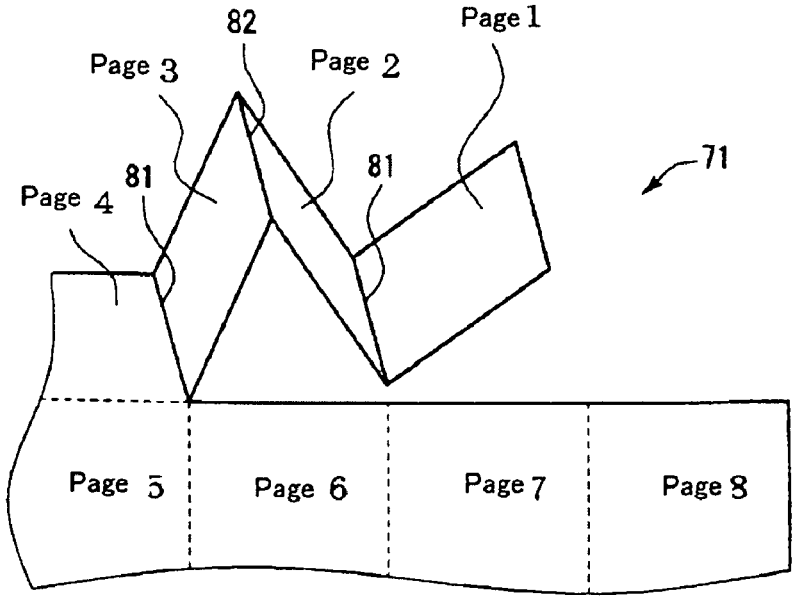
Figure 15B:
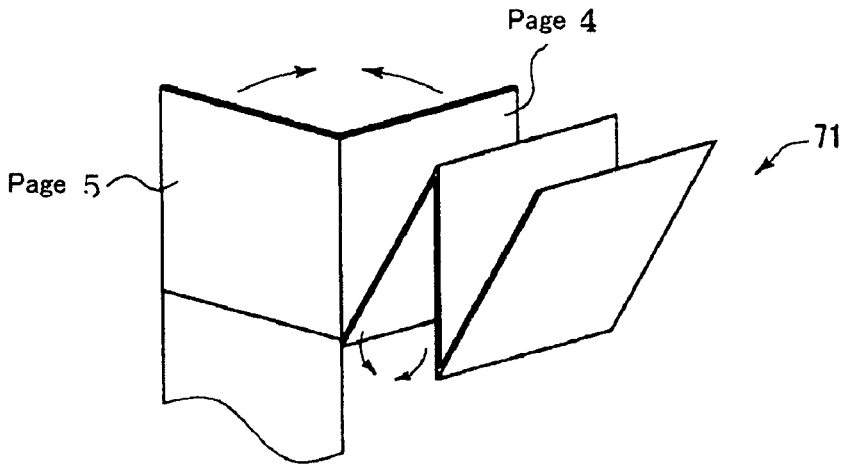
Figure 15C:
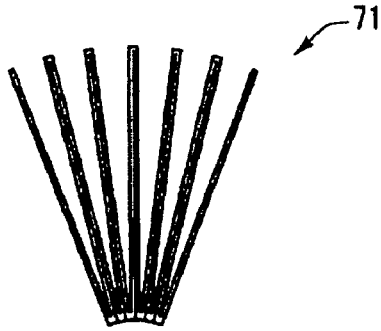

FIG. 15A shows the cutting between the first line and second line and forming between "Fold away from you" 81 and "Fold toward you" 82 of printing paper and bending of printing paper. In "Fold away from you" line of a border of page area 1 and page area 2, the bending of the printing paper is done in "Fold away from you". The bending of the printing paper is done in "Fold toward you" line of page area 2 and page area 3 in "Fold toward you". The bending of the printing paper is done in "Fold away from you" line of page area 3 and page area 4 next in "Fold toward you". And it is done in "Fold toward you" line of a border of page area 4 and page area 5 in "Fold toward you" as shown in FIG. 15B. About a boundary line of a page area of the second line and third line, the printing paper is bended in the same procedure as follows. It is made adhesive together in the rear side of a page area by peeling off the releasing paper 92 which is the page area. FIG. 15C shows the booklet.

Figure 16A:
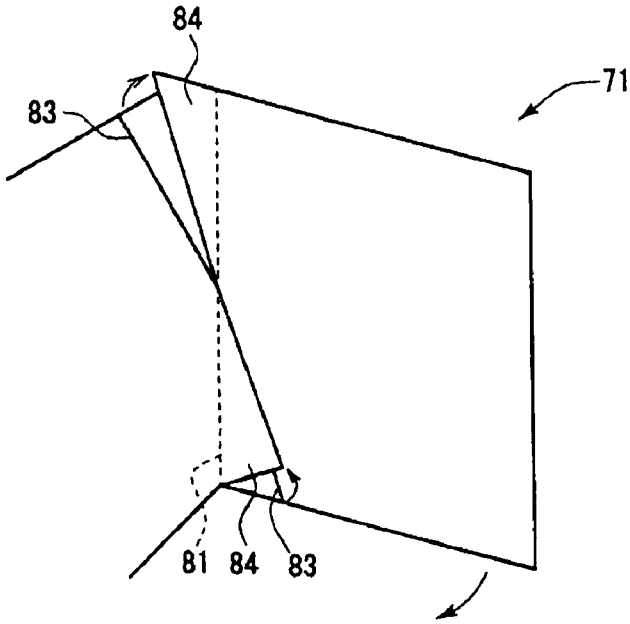
Figure 16B:
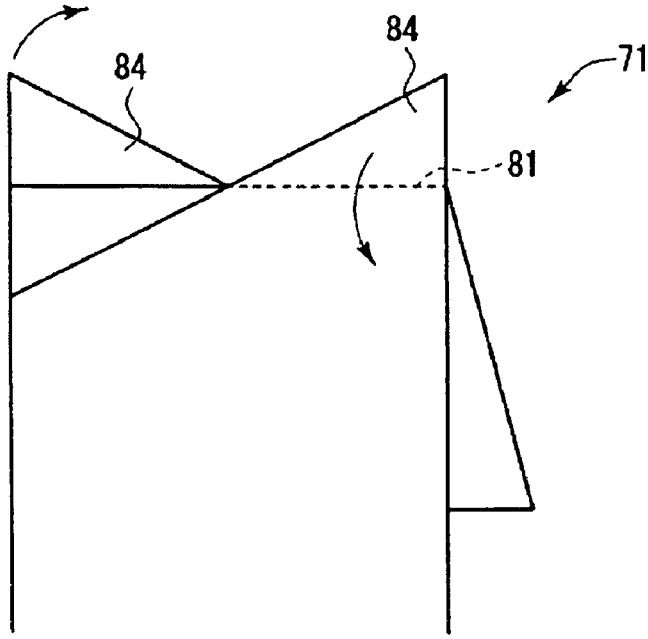

FIG. 16A and FIG. 16B show the process of peeling-off of the releasing paper for bonding of the printing paper. FIG. 16A shows the rear surface of printing paper 71. The rear surface of printing paper 71 is formed therein releasing-assist formation line 83 which is positioned diagonally to "Fold away from you" line 81. Releasing-assist formation line 83 is configured as a slit formed on the releasing paper, wherein the slit does not reach to printing paper 90 on which printing is performed.

By folding at folding line 81 between the page region as shown in FIG. 16B, the tab portion 84 of the releasing paper is peeled off from releasing-assist formation line 83. The tab portion 84 can be manipulated by fingers, and pulled in the direction indicated by the arrow shown in FIG. 16B and peeled off from releasing paper.

By forming the tab portion in the vicinity of the folding line as described in the above, the tab portion 84 is peeled off when the printing paper 71 is folded at the folding line because of the smallness of the area and the weakness of the tackiness of tab portion 84. This makes it possible to peel off the releasing paper 92 by picking the tab portion 84 thereof. The shape of tab portion is not limited to this described one. Provided that the tab can be peeled off from the adhesive layer upon being folded, any geometric shape will suffice. For this reason, the tab portion 84 with a small area is preferred, whereby a larger area would result in a adhesive tolerant enough to withstand the folding, and would fall in peeling off of the tab portion 84 even if the printing paper is folded.

Figure 17A:
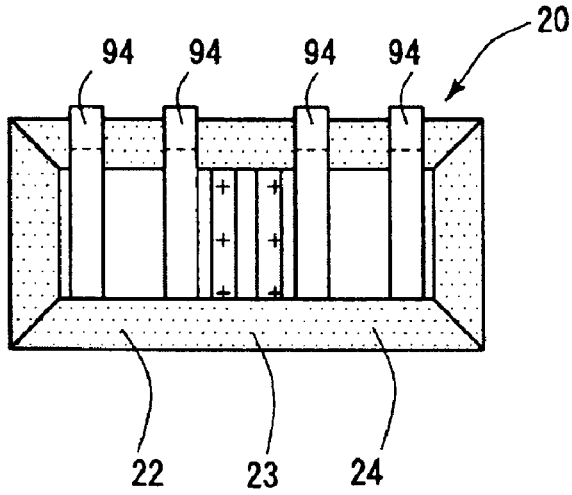
Figure 17B:
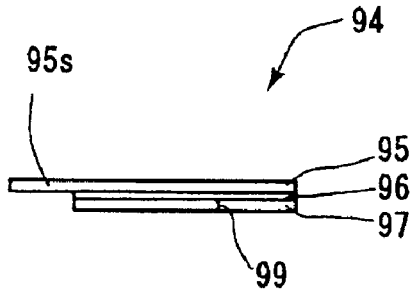

FIG. 17A shows the double-sided pressure sensitive auxiliary materials 94 which bond to in-sides of booklet cover 20. The auxiliary materials 94 are composed of the base sheet which include the double-sided adhesive sheet 96, the first releasing paper which is formed largely in longitudinal than the base sheet 96, and the second releasing paper 97 which is the same size as the base sheet 96. The second releasing paper 97 is formed next to slitting 99 and is easy to peel off and adhere to booklet cover 20 as shown FIG. 17A. After the adhesion of the auxiliary materials, the end of first releasing paper 95 is over the cover sheet 20 and it is easy to peel off the releasing paper. The adhesion with the auxiliary materials and the book cover makes strong connection with printing paper 71 and booklet cover 20.

Figure 18A:
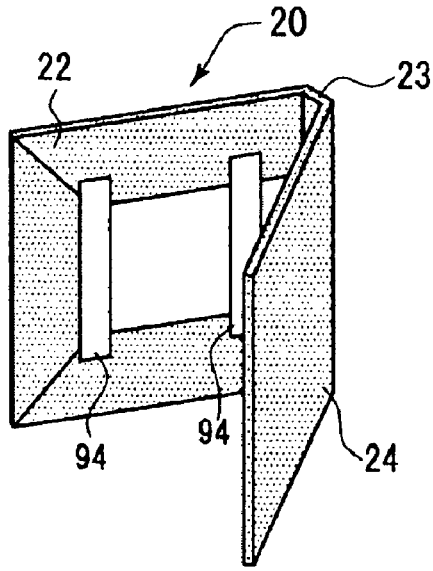
Figure 18B:
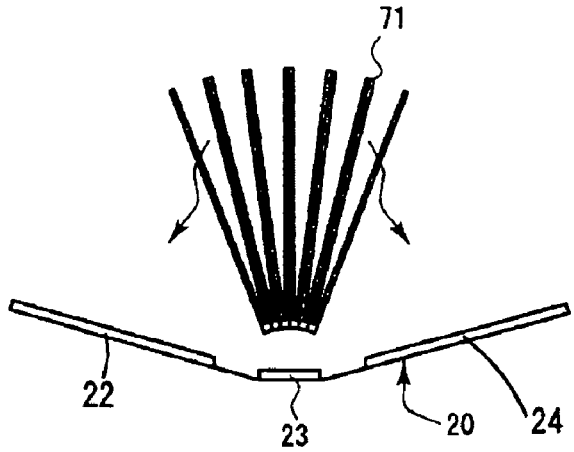
Figure 18C:
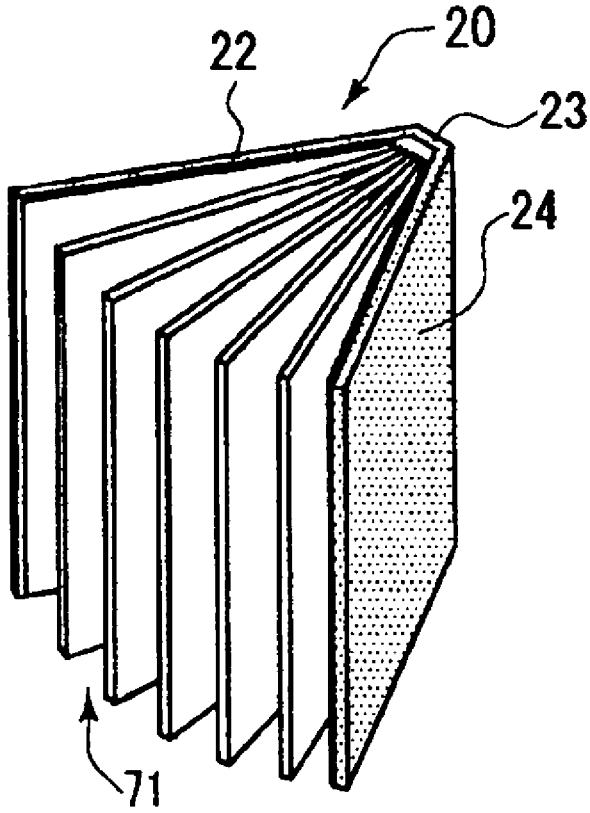

FIG. 18A show the perspective view of the finished booklet cover. The surface of booklet cover is covered with cover 58 or cover seal 2 for the booklet, showing a good design. As shown in FIG. 18B, printing paper 71 (fold section) obtained by folding and bundling in the process steps is attached to booklet cover 20. FIG. 18C is the final album booklet.

As explained above, users can easily make a booklet cover how they like by using the cover sheet 1 and cover core components or can easily make the booklet cover how they like by using double-sided adhesive pressure sensitive sheet 41, cover core components, and cover sheet 58.

The invention claimed is:

1. A method of creating a booklet cover, comprising:

preparing:

a coversheet including:

a cover sticker having an adhesion layer formed on a back surface thereof; and a releasing paper adhered, peelable to the cover sticker, on the back surface of the cover sticker having the adhesion layer therebetween, having a splitting section, peelable by splitting into at least two, formed along in a longitudinal direction form an edge of one side to that of the other; and an interlining including:

a back cover member to be a back cover of a booklet;

a first cover member contiguous to the back cover member having space therebetween;

a second cover member contiguous having space therebetween, opposite to the first cover member of the back cover member; and a frame detachable to the back cover member, first cover member and second cover member; and peeling a part of the releasing paper, and then disposing the coversheet over a first surface of the interlining by superposing respective outermost corners of the coversheet and the frame member of the interlining so as to be positioned;

adhering the back cover member, the first cover member and the second cover member with the adhesion layer of the cover sticker to be fixed, so as to detach the remaining frame; and further peeling off the remaining releasing paper, and then covering the first cover member, the second cover member and the back cover member unitedly with the cover sticker, so as to be booklet cover.

2. The method of creating the booklet cover according to claim 1, wherein the coversheet is a preprinted coversheet, the method comprising:

disposing the preprinted coversheet over the first surface of the interlining by superposing respective outermost corners of the coversheet and the frame member of the interlining so as to be positioned, after peeling a part of the releasing paper.

3. A booklet cover kit comprising:

a coversheet including:

a cover sticker, to be printed on a surface thereof, having an adhesion layer formed on a back surface thereof; and a releasing paper adhered, peelable to the cover sticker, on the back surface of the cover sticker having the adhesion layer therebetween, having a splitting section, peelable by splitting into at least two, formed along in a longitudinal direction form an edge of one side to that of the other; and an interlining including:

a back cover member to be a back cover of a booklet;

a first cover member contiguous to the back cover member having space therebetween;

a second cover member contiguous having space therebetween, opposite to the first cover member of the back cover member; and a frame detachable to the back cover member, first cover member and second cover member; wherein an outermost outline of the frame member of the interlining and an outline of the coversheet have the same square shape and size the coversheet is arranged to dispose over a first surface of the interlining, after a part of the releasing paper is peeled, by superposing outermost corners of the coversheet and the frame member of the interlining so as to be positioned, wherein the back cover member, the first cover member and the second cover member are arranged to adhere with the adhesion layer of the cover sticker to be fixed so as to detach the remaining frame, and the cover sticker is arranged, after a remainder of the releasing paper is peeled off, to cover unitedly the first cover member, the second cover member and the back cover member so as to be a booklet cover.

4. The booklet cover kit according to claim 3, wherein the releasing paper of the coversheet comprises:

a center portion formed in a center area along in a longitudinal direction form an edge of one side thereof to that of the other; and a first side portion and a second side portion on both sides of the center portion.

5. The booklet cover kit according to claim 3, wherein the cover sticker of the cover sheet has four corners having been cut respectively.

* * * * *